US005488667A

United States Patent [19]

Tamamura et al.

[11] Patent Number: 5,488,667

[45] Date of Patent: Jan. 30, 1996

[54] VEHICLE INTERNAL NOISE REDUCTION SYSTEM

[75] Inventors: Manpei Tamamura, Ohta; Hiroshi Iidaka, Koganei; Eiji Shibata, Gunma, all of Japan

[73] Assignee: Fuji Jukogyo Kabushiki Kaisha, Tokyo, Japan

[21] Appl. No.: 180,995

[22] Filed: Jan. 14, 1994

[30] Foreign Application Priority Data

Feb. 1, 1993 [JP] Japan ..... 5-014927

[51] Int. Cl.[6] ..... G10K 11/16

[52] U.S. Cl. ..... 387/71; 381/94

[58] Field of Search ..... 381/71, 73.1, 86, 381/94

[56] References Cited

U.S. PATENT DOCUMENTS 4,783,818 11/1988 Graupe et al. ..... 381/71

5,131,047 7/1992 Hashimoto et al. ..... 381/73.1

5,222,148 6/1993 Yuan ..... 381/94

5,325,437 6/1994 Doi et al. ..... 381/86

5,386,472 1/1995 Pfaff et al. ..... 381/94

5,388,160 2/1995 Hashimoto et al. ..... 381/94

*Primary Examiner*—Stephen Brinich

*Attorney, Agent, or Firm*—Beveridge, DeGrandi, Weilacher & Young

[57] ABSTRACT

The vehicle internal noise reduction system characterized in attenuating the internal noises by generating optimum canceling sounds from speakers disposed in the passenger compartment by varying the canceling sounds with a good balance according to vehicle operating conditions as changing rapidly.

15 Claims, 6 Drawing Sheets

VEHICLE INTERNAL NOISE REDUCTION SYSTEM

BACKGROUND OF THE INVENTION

The present invention relates to a noise reduction system for a passenger compartment of an automotive vehicle by positively generating a sound to cancel the vehicle internal noise.

There have been proposed several techniques for reducing the noise sound in the passenger compartment by producing a canceling sound from a sound source disposed in the passenger compartment. The canceling sound has the same amplitude as the noise sound, but has a reversed phase thereto.

As a recent example, Japanese application laid open No. 1991-204354 discloses a vehicle internal noise reduction technique for reducing a noise sound by using a LMS (Least Means Square) algorithm (a theory for obtaining a filter coefficient by approximating it to a means square error in order to simplify a formula, utilizing that a filter correction formula is a recursive expression) or by employing a MEFX-LMS (Multiple Error Filtered X-LMS) algorithm. This technique has already been put to a practical use in some of vehicles. Commonly, an internal noise reduction system using this LMS algorithm is composed in such a way that: vibration noise source signal (primary source) is detected from an engine, the primary source is synthesized with a filter coefficient of an adaptive filter into a canceling sound, the canceling sound is generated from a speaker to cancel a noise sound in the passenger compartment; the noise sound reduced by the canceling sound is detected as an error signal by a microphone disposed at a noise receiving point; and based on the detected error signal and a compensation signal synthesized with a predetermined coefficient a filter coefficient of the adaptive filter is updated by the LMS algorithm so as to optimize the reduced noise sound at the noise receiving point.

It is known that an effective way for reducing an internal noise by producing a canceling sound is to coincide the direction from which the canceling sound comes with the one from which a vibration noise comes. That is to say, as indicated in FIGS. 5(*a*), (*b*), (*c*), (*d*) and (*e*), in case where the canceling sound comes from the same direction as the vibration noise, both are canceled each other at any position, providing that a noise sound and a canceling sound are plane waves having the same amplitude, the same frequency and a reversed phase to each other. However, on the other hand, in case where the canceling sound comes from an opposite direction to the vibration noise as shown in FIGS. 6(*a*), (*b*), (*c*), (*d*) and (*e*), the canceling sound cancels the vibration noise at the position of $n\lambda/2$ (for example, positions $X_a$ and $X_b$), but at the position of $(1+2n)\ \lambda/4$ (for example, a position $X_c$, mid-point of Xa and Xb) the vibration noise is interfered with the canceling sound and as a result of this interference it is amplified on the contrary (a relationship of the standing wave), where n is integers and $\lambda$ is a wave length. Especially, a noise reduction system using the LMS algorithm, among others, the MEFX-LMS algorithm has plural speakers from which canceling sounds are generated to cancel noise sounds at plural positions where a microphone is placed and plural independent control circuits for making control processes individually, therefore it happens that internal noise sounds changing rapidly according to operating conditions of engine could be reduced at a position where a microphone is located but could not at other positions away from the microphone. Further, depending on an operational condition of engine, the noise sounds may be amplified and get worse than in a case where no noise reduction control is performed.

SUMMARY OF THE INVENTION

The present invention has been made in order to solve the aforementioned problems. An object of the present invention is to provide an internal noise reduction system for vehicle that can reduce noise sounds changing according to operational conditions of engine efficiently and has a wide coverage of areas where noises are reduced in the passenger compartment.

To achieve the above object, the internal noise reduction system according to the present invention comprises:

operational conditions detecting means for detecting an engine operational condition signal; canceling signal synthesizing means for synthesizing a vibration noise source signal with a filter coefficient of an adaptive filter into a canceling signal; canceling sound generating means responsive to the canceling signal for generating a canceling sound from a speaker (canceling sound source) so as to cancel the vibration noise sounds within the passenger compartment; error signal detecting means for detecting a state of noise reduction at a noise receiving point as an error signal; compensation coefficients determining (system identification) means for determining a series of compensation coefficients; compensations coefficients memorizing means for memorizing the series of compensation coefficients; compensation coefficients selecting means responsive to the engine operational condition signal for selecting a compensation coefficient from within the series of compensation coefficients memorized in the compensation coefficients memorizing means; input signal compensating means for compensating the vibration noise source signal by the compensation coefficient; and filter coefficients updating means responsive to an output signal from the input signal compensating means and responsive to the error signal for updating the filter coefficient of the adaptive filter.

Next, based on the composition of means abovementioned, a brief description about a function of the noise reduction system according to the present invention will be made.

First, an engine operating condition is detected by the operational conditions detecting means. Next, according to the detected engine operational condition a compensation coefficient stored beforehand is selected and inputted into the input signal compensating means. Further, when a vibration noise that is derived primarily from the engine is generated in the passenger compartment, in the canceling signal synthesizing means a vibration noise source signal having a high correlation with the engine vibration is synthesized into a canceling signal by the adaptive filter and then in the canceling sound generating means the canceling signal is generated as a canceling sound from a sound source to cancel the noise sound in the passenger compartment. Next, a state of noise reduction at the noise receiving point is detected as an error signal by the error signal detecting means. On the other hand, the vibration noise source signal is inputted into the input signal compensating means and then is synthesized with the compensation coefficient therein. The synthesized vibration noise source signal is transmitted to the filter coefficients updating means where the filter coefficient of the adaptive filter is updated based on the synthesized vibration noise source signal and the error signal.

BRIEF DESCRIPTION OF THE DRAWINGS

The present invention will be described hereinafter in connection with the accompanying drawings, in which:

FIG. 1 to FIG. 4 show a preferred embodiment according to the present invention, among them FIG. 1 illustrates a schematic view of an internal noise reduction system according to the present invention;

FIG. 2 is a schematic view showing the process for obtaining a compensation coefficient;

FIG. 3 is a conceptional illustration for explaining compensation coefficients stored in a memory;

DESCRIPTION OF THE PREFERRED EMBODIMENTS

Figure 1:
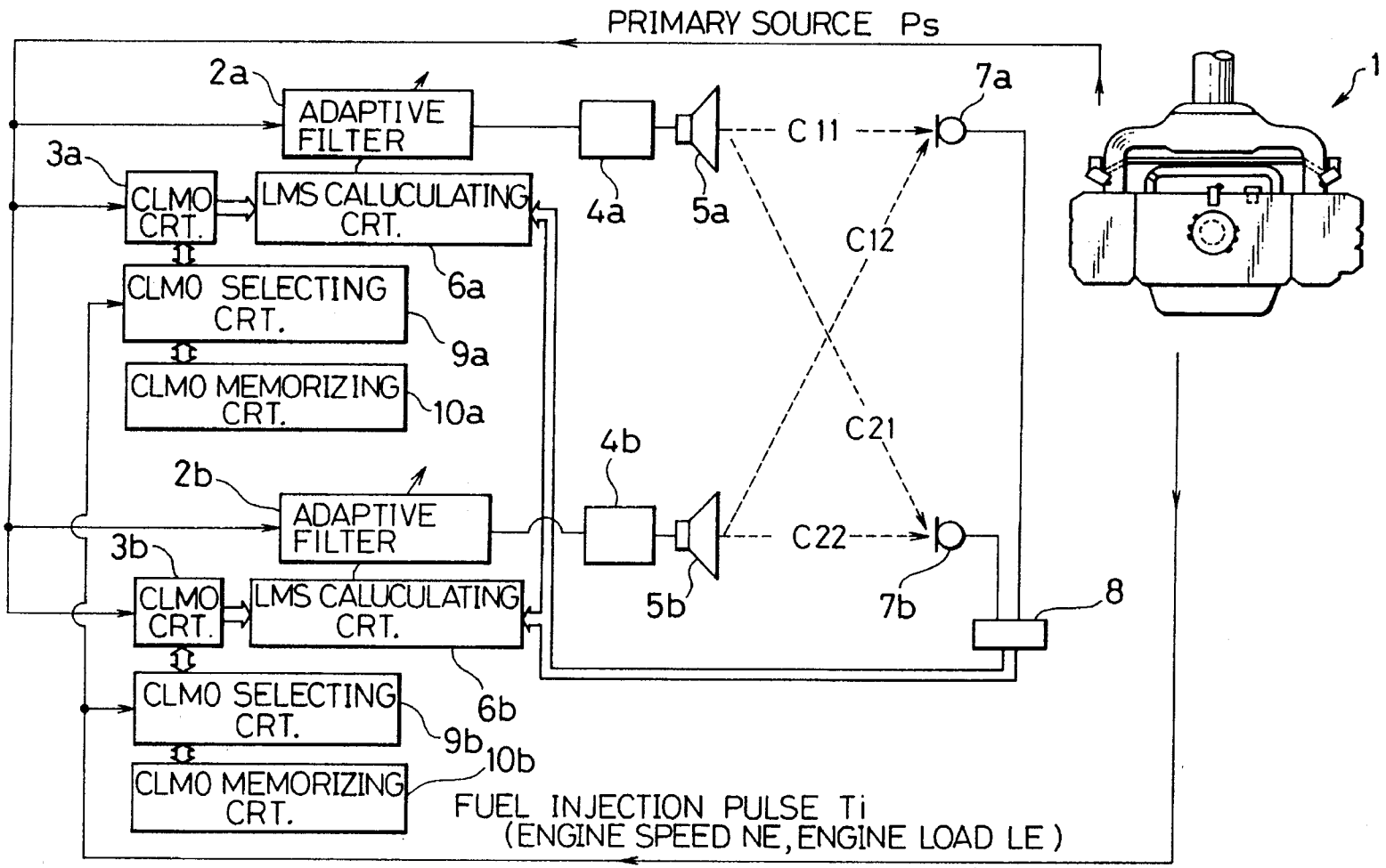

In FIG. 1, a vibration noise source signal which is generated from an engine 1 is referred to as a primary source $P_s$ hereinafter. The noise reduction system according to this preferred embodiment is so composed as the primary source $P_s$ from the engine 1 is inputted into two channels for convenience of explanation. The primary source $P_s$ is inputted into canceling signal synthesizing means, adaptive filters 2*a* and 2*b* and further inputted into input signal compensating means, compensation coefficient synthesizing circuits 3*a* and 3*b* (hereinafter referred to as $C_{LMO}$ circuit). The adaptive filter 2*a* is connected to canceling sound generating means, namely a speaker 5*a* disposed at the front side of the passenger compartment via a canceling signal processing circuit 4*a* and further the adaptive filter 2*b* is connected to canceling sound generating means, namely a speaker 5*b* disposed at the rear side of the passenger compartment via a canceling signal processing circuit 4*b*. Further, $C_{LMO}$ circuits 3*a* and 3*b* are connected to LMS calculating circuits 6*a* and 6*b* respectively which act as filter coefficient updating means described hereinafter.

At the front noise receiving point (for example, at a position adjacent to a driver's ears or a front passenger's ones), an error microphone 7*a* for detecting a noise reduction state as an error signal at the noise receiving point and at the rear noise receiving point (for example, at a position adjacent to a rear passenger's ears), an error microphone 7*b* for detecting a noise reduction state as an error signal at the noise receiving point are disposed respectively. These error microphones 7*a* and 7*b* are connected to the LMS calculating circuits 6*a* and 6*b* via an error signal processing circuit 8.

For convenience of explanation, hereinafter, the speaker 5*a* of the front passenger compartment is designated as No. 1, the speaker 5*b* of the rear passenger compartment as No. 2, the error microphone 7*a* of the front passenger compartment as No. 1 and the error microphone of the rear passenger compartment as No. 2.

It is necessary that the primary source $P_s$ has a high correlation with a vibration noise of the engine 1. As a primary source, signals synthesized and wave-shaped with ignition pulses, fuel injection pulses, signals from a crank angle sensor (not shown) or signals synthesized with these information and other engine loading information are used for this purpose.

Further, the adaptive filter 2*a* is a FIR (Finite Impulse Response) filter which has filter coefficients $W_{1(n)}$ updated by a LMS calculating circuit 6*a* and has a specified number of taps (for example 512 taps) therein. The LMS calculating circuit acts as filter coefficients updating means. The primary source $P_s$ inputted to the adaptive filter 2*a* is subjected to the sum of convolution products with the filter coefficients $W_{1(n)}$ and outputted as a canceling signal. Similarly, the adaptive filter 2*b* is a FIR (Finite Impulse Response) filter which has filter coefficients $W_{2(n)}$ updated by a LMS calculating circuit 6*b* and has a specified number of taps (for example 512 taps) therein. The LMS calculating circuit acts as filter coefficients updating means. The primary source $P_s$ inputted to the adaptive filter 2*b* is subjected to the sum of convolution products with the filter coefficients $W_{2(n)}$ and outputted as a canceling signal.

Figure 2:
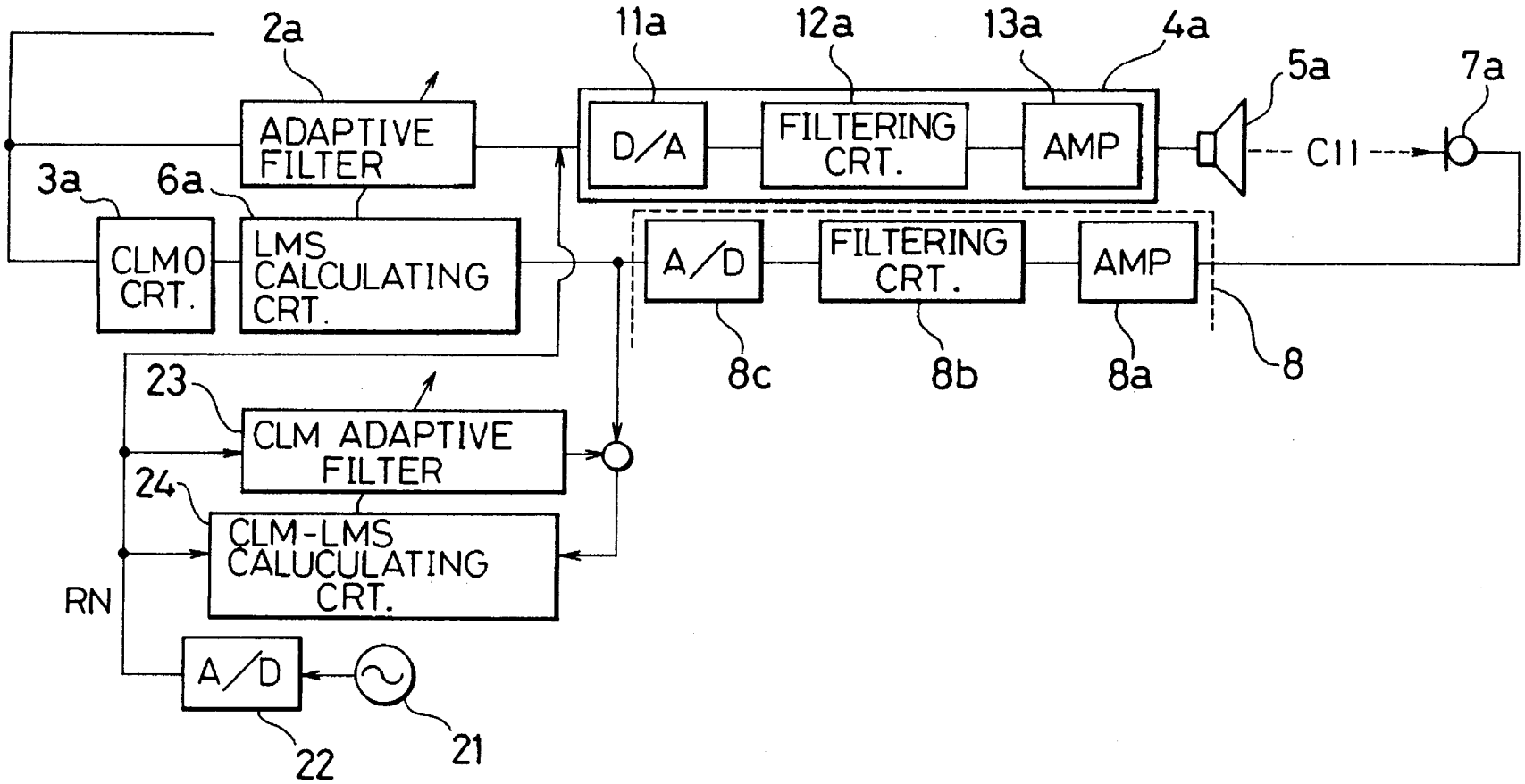

Referring to FIG. 2, the canceling signal processing circuit 4*a* comprises mainly a D/A (digital to analogue) conversion circuit 11*a*, a filtering circuit (an analogue filter through which only particular frequency band can be passed) 12*a* and an amplifier circuit 13*a*. Also the canceling signal processing circuit 4*b* is composed similarly.

Further, referring back to FIG. 1, in the aforementioned $C_{LMO}$ circuit 3*a*, compensation coefficients $C_{110}$ and $C_{210}$ have been established. The compensation coefficient $C_{110}$ is a coefficient to compensate a delay time needed for processing and transmitting signals from the adaptive filter 2*a* to the LMS calculating circuit 6*a* via the error microphone 7*a*, an effect of speaker/microphone transmission characteristics $C_{11}$, and a phase shift during transmission. Also the compensation coefficient $C_{210}$ is a coefficient to compensate a delay time needed for processing and transmitting signals from the adaptive filter 2*a* to the LMS calculating circuit 6*a* via the error microphone 7*b*, an effect of speaker/microphone transmission characteristics $C_{21}$, and a phase shift during transmission. Similarly in the aforementioned $C_{LMO}$ circuit 3*b*, compensation coefficients $C_{120}$ and $C_{220}$ have been established. The compensation coefficient $C_{120}$ is a coefficient to compensate a delay time needed for processing and transmitting signals from the adaptive filter 2*b* to the LMS calculating circuit 6*b* via the error microphone 7*a*, an effect of speaker/microphone transmission characteristics $C_{12}$, and a phase shift during transmission. Also the compensation coefficient $C_{220}$ is a coefficient to compensate a delay time needed for processing and transmitting signals from the adaptive filter 2*b* to the LMS calculating circuit 6*b* via the error microphone 7*b*, an effect of speaker/microphone transmission characteristics $C_{22}$, and a phase shift during transmission.

The abovementioned compensation coefficients $C_{LMO}$ (subscription L indicates an identification number of an error microphone and subscription M does an identification number of a speaker as designated before), namely $C_{110}$, $C_{210}$, $C_{120}$ and $C_{220}$ are established as a series of the infinite (for instance 64 taps) impulse response values respectively in the $C_{LMO}$ circuits. When the primary source $P_s$ is inputted to the $C_{LMO}$ circuit 3*a*, it is subjected to the sum of convolution products with the compensation coefficients, $C_{110}$ and $C_{210}$ and then outputted to the LMS calculation circuit 6*a*. Similarly when the primary source $P_s$ inputted to the $C_{LMO}$ circuit, it is subjected to the sum of convolution products with the compensation coefficients $C_{120}$ and $C_{220}$ and then outputted to the LMS calculating circuit 6*b*.

Further the $C_{LMO}$ circuit 3*a* is connected to a $C_{LMO}$ selecting circuit 9*a* which composes the compensation coefficients selecting means. The $C_{LMO}$ selecting circuit 9a is connected to a $C_{LMO}$ memorizing circuit 10a which is a memory part of the compensation coefficients selecting means. Similarly the $C_{LMO}$ circuit 3b is connected to a $C_{LMO}$ selecting circuit 9b which composes the compensation coefficients selecting means. The $C_{LMO}$ selecting circuit 9b is connected to a $C_{LMO}$ memorizing circuit 10b which is a memory part of the compensation coefficients selecting means.

Figure 3:
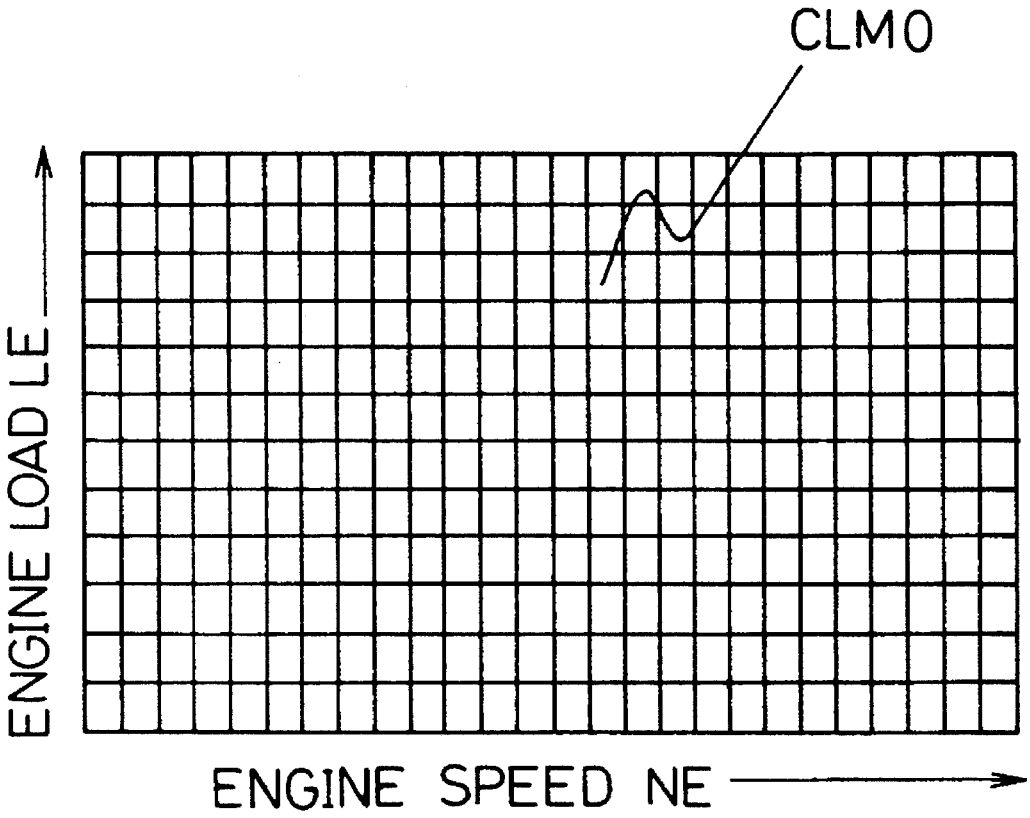

Further a fuel injection pulse $T_i$ derived from the engine 1 is inputted to the $C_{LMO}$ selecting circuits 9a and 9b in which an operational condition of the engine 1 is obtained based upon the above fuel injection pulse $T_i$, that is to say, an engine loading information $L_E$ is obtained from the fuel injection pulse width and an engine rotational speed information $N_E$ is obtained from the fuel injection pulse interval respectively. According to these information, a compensation coefficient $C_{LMO}$ is selected from the $C_{LMO}$ memorizing circuits 10a and 10b respectively and then set to the respective $C_{LMO}$ circuit of 3a and 3b. In the $C_{LMO}$ memorizing circuit, as depicted in FIG. 3, the compensation coefficients $C_{110}$, $C_{210}$, $C_{120}$ and $C_{220}$ which have been derived from experimental data or the like are stored on maps parameterizing the engine loading $L_E$ and the engine speed $N_E$.

On the other hand, the LMS calculating circuits 6a and 6b are those for updating the filter coefficients $W_{1(n)}$ and $W_{2(n)}$ of the adaptive filters 2a and 2b based on the error signals from the error microphones 7a and 7b and the signals from the $C_{LMO}$ circuits 3a and 3b respectively according to a well known LMS algorithm.

A filter coefficient $W_{m(n)}$ of the adaptive filter connected to a No. m speaker is updated according to the following equation:

$$W_{mi(n+1)}=W_{mi(n)}-\mu\Sigma e_{L(n)}\cdot\Sigma C_{LiMO}\cdot X_{(n-i)} \quad (1)$$

where, $W_{mi(n+1)}$ is a "i" th filter coefficient after being updated;

$W_{mi(n)}$ is a "i" th filter coefficient to be updated; $\mu$ is a step size (constant);

$e_{L(n)}$ is a signal from No. L error microphone;

$C_{LiMO}$ is a "i" th $C_{LMO}$; and $X_{(n-i)}$ is a value of the primary source $P_s$ which comes earlier by "i" th.

Next, the compensation coefficients stored in the CLMO memorizing circuits 10a and 10b will be explained based on FIGS. 4(*a*), (*b*) and (*c*).

Figure 4A:
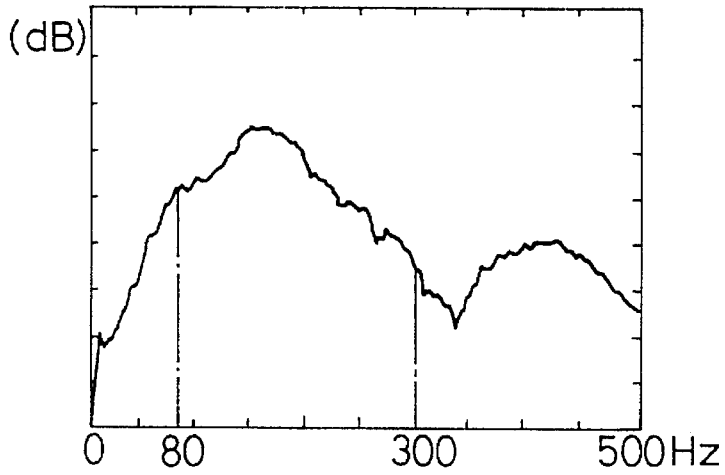
FIGS. 4*a*–4*c* are graphical illustrations for explaining a compensation coefficient expressed in a frequency domain.
Figure 4B:
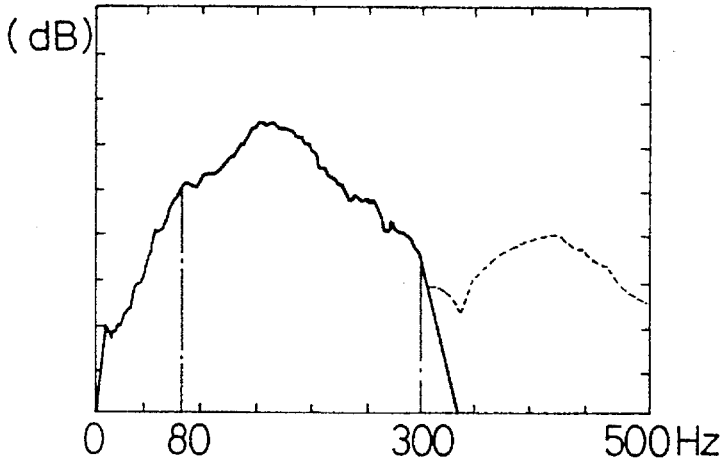
Figure 4C:
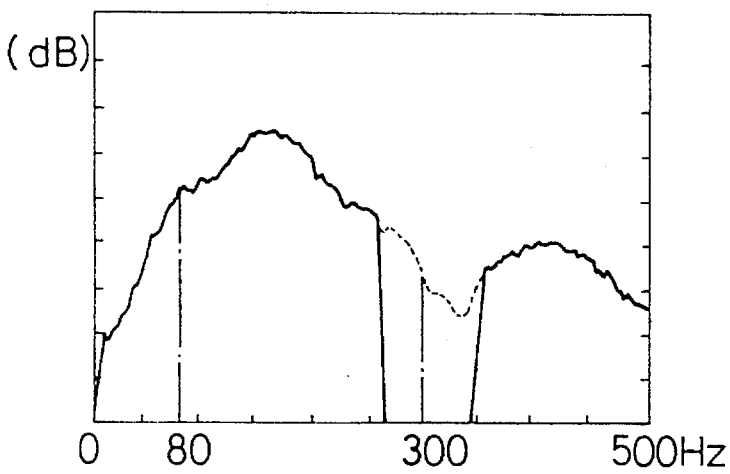
Figure 5:
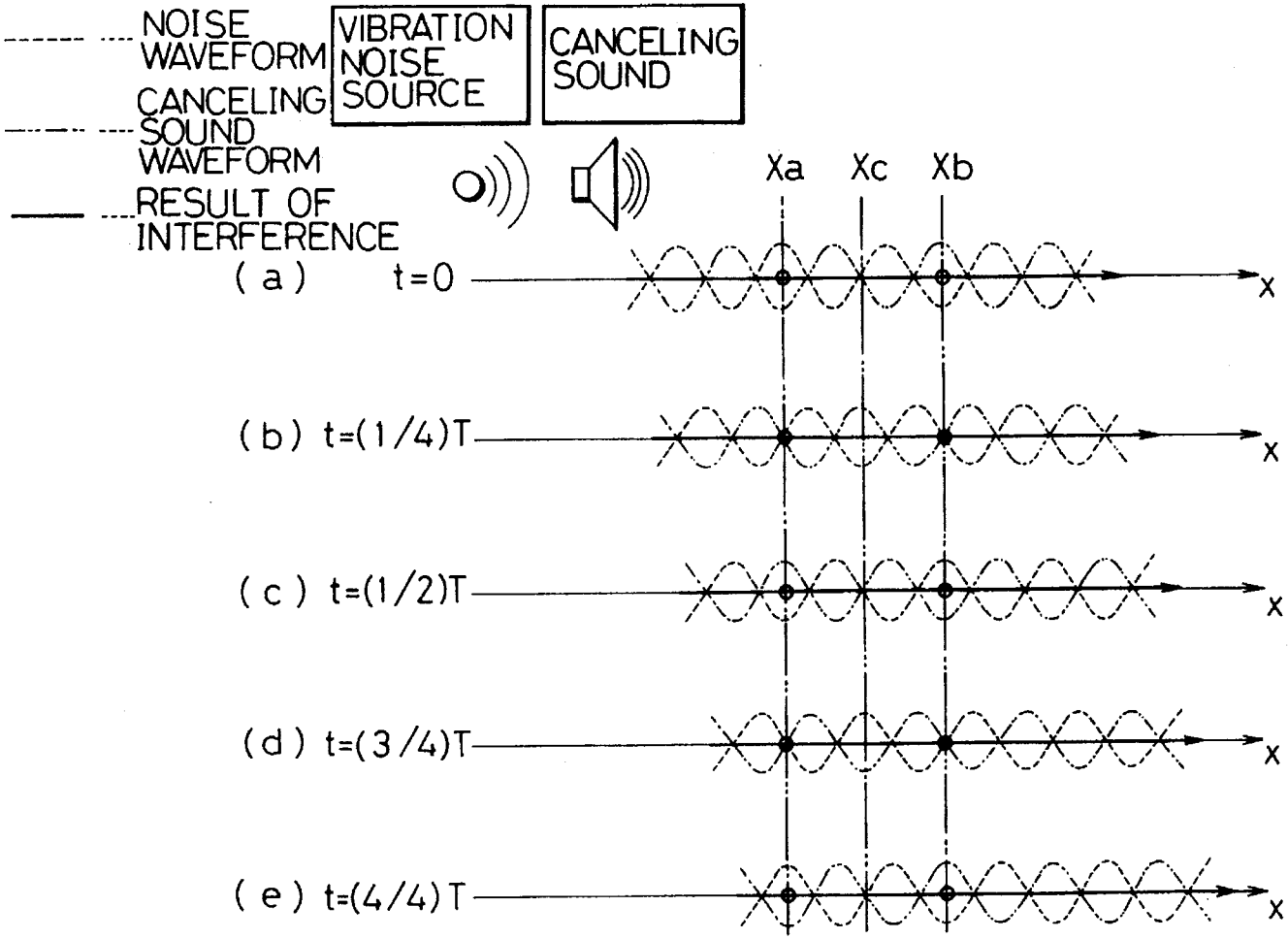
FIG. 5 and FIG. 6 are illustrations for explaining the difference of features in noise reduction between the case where the canceling sound comes from the same direction as a noise source and the case where the canceling sound comes from an opposite direction to a noise source.
Figure 6:
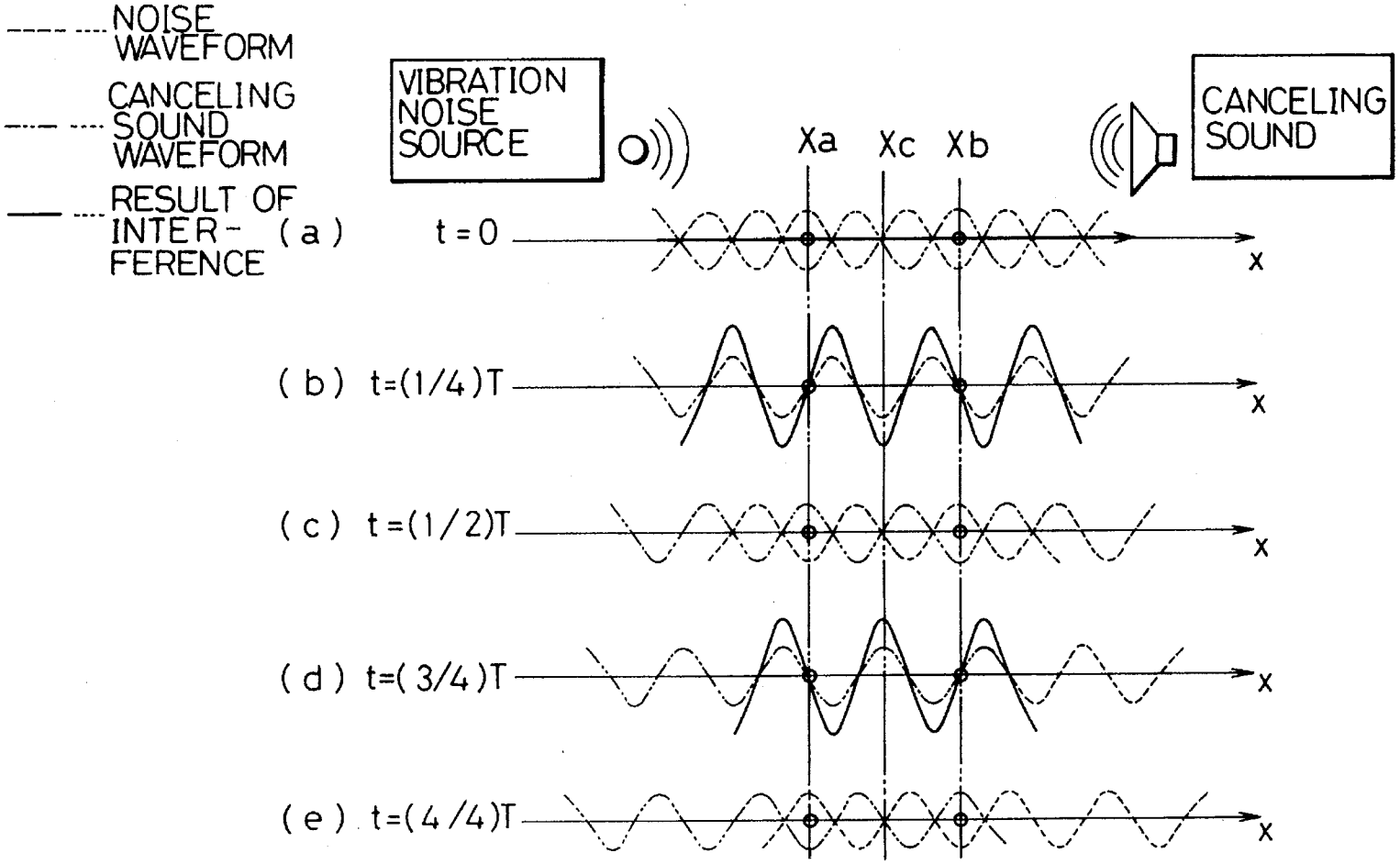

The illustrations in FIG. 4 are shown as an example of the compensation coefficient $C_{210}$ which is expressed in the frequency domain. Referring now to FIG. 4(*a*), the magnitude is lowered at the frequency bands below 80 Hz and near 300 Hz. The reason why the magnitude is low at the frequency band below 80 Hz is that the reproducing ability of the speaker 5a is inferior at the low frequency band. On the other hand, the reason why the magnitude is low at the frequency band near 300 Hz is because of acoustic characteristics (transmission characteristics $C_{21}$) of the passenger compartment, consequently this shows that a canceling sound near 300 Hz generated from the speaker 5a does not reach the error microphone 7b. With this in mind, the compensation coefficient $C_{210}$ can be designed in such a way that its magnitude is rendered null above 300 Hz as illustrated in FIG. 4(*b*), or near 300 Hz as shown in FIG. 4(*c*) so as to deactivate the noise reduction between the speaker 5a and the error microphone 7b. By designing the compensation coefficients $C_{210}$ in this way, it becomes possible to perform an efficient control for noise reduction according to operating conditions. The most efficient combination of the compensation coefficients $C_{LMO}$ according to operating conditions is determined by experiments or the like (a system identification described hereinafter) beforehand and stored in the $C_{LMO}$ memorizing circuits 10a or 10b.

Next, it will be explained how the compensation coefficients $C_{LMO}$ is determined according to a system identification by referring to FIG. 2. The explanation will be made only about the example in determining the $C_{110}$.

Referring to FIG. 2, numeral 21 denotes a random noise generator for generating a random noise $R_N$. The random noise $R_N$ generated from the random noise generator 2 is inputted to the aforementioned canceling signal processing circuit 4a, a $C_{LM}$ adaptive filter 23 and a $C_{LM}$-LMS calculating circuit 24 through an A/D (analogue to digital) converter 22. The random noise $R_N$ inputted to the canceling signal processing circuit 4a is generated from the speaker 5a after passing through the D/A converter 11a, the filtering circuit 12a and an AMP (amplifier) circuit 13a and is detected by the error microphone 7a after being subjected to an influence of the speaker/microphone transmission characteristics $C_{11}$. The detected random noise $R_N$ is inputted to the error signal processing circuit 8 and outputted via an AMP circuit 8a, a filtering circuit 8b and an A/D converter 8c thereof. On the other hand, the random noise $R_N$ inputted to the $C_{LM}$ adaptive filter 23 is synthesized with a signal from the error signal processing circuit 8 and then the synthesized signal is inputted to the $C_{LM}$-LMS calculating circuit 24 after being subjected to the sum of convolution products with a filter coefficient $W_{c11(n)}$ of the $C_{LM}$ adaptive filter 23. Further, in the $C_{LM}$-LMS calculating circuit 24 the filter coefficient $W_{c11(n)}$ of the $C_{LM}$ adaptive filter 23 is so determined as to make the synthesized signal null by the $L_{MS}$ algorithm based on the inputted random noise $R_N$ and the synthesized signal and then it is updated therein. The updated filter coefficient $W_{c11(n)}$ is stored as a $C_{110}$ in the $C_{LMO}$ memorizing circuit 10a after being processed by a digital filter with linear-phase characteristics so as to compensate delay.

Similarly, $C_{210}$, $C_{120}$ and $C_{220}$ are determined according to the system identification described above are stored in the $C_{LM}$ memorizing circuits 10a and 10b.

Next, it will be described how the internal noise reduction system according to the above composition is operated.

First, a vibration noise of the engine 1 is transmitted to the passenger compartment through engine mountings (not shown) and becomes an internal noise therein. Further, intake and exhaust noises of the engine 1 are transmitted to the passenger compartment. These noises reach a noise receiving point in the passenger compartment after being multiplied by the body transmission characteristics.

On the other hand, a fuel injection pulse $T_i$ determined by the engine 1 is inputted to the $C_{LMO}$ determining circuits 9a and 9b. Based on this fuel injection pulse $T_i$ an engine operating condition, namely an engine loading information $L_E$ and an engine rotational speed information $N_E$ are obtained respectively from the pulse width (time) of $T_i$ and the pulse interval thereof. In the $C_{LMO}$ selecting circuit 9a, based on these information $L_E$ and $N_E$, compensation coefficients $C_{110}$ and $C_{210}$ are selected from the maps for the compensation coefficients $C_{110}$ and the ones for the compensation coefficients $C_{210}$ stored in the $C_{LMO}$ memorizing circuit 10a and established in the compensation coefficients synthesizing circuit (hereinafter referred to as $C_{LMO}$ circuit) 3a . The compensation coefficient $C_{110}$ is so determined as to be high in magnitudes over all frequency bands in order to reduce the vibration noises preferentially at the noise receiving point of the front passenger compartment and on the other hand the compensation coefficient $C_{210}$ is so determined as to be a value with a particular frequency band cut off as illustrated in FIG. 4(*b*) or FIG. 4(*c*).

Similarly, in the $C_{LMO}$ selecting circuit 9*b*, based on above $L_E$ and $N_E$ information, compensation coefficients $C_{120}$ and $C_{220}$ are selected from the map for the compensation coefficients $C_{120}$ and the one for the compensation coefficients $C_{220}$ stored in the $C_{LMO}$ memorizing circuit 1O*b* and established in the $C_{LMO}$ circuit 3*b*. These compensation coefficients $C_{120}$ and $C_{220}$ are so established as not only to reduce the vibration noises preferentially at the noise receiving point of the rear passenger compartment but also to be lower in magnitudes than $C_{210}$ and $C_{110}$ respectively since the source of vibration noises is located at the front side of the vehicle at this moment.

On the other hand, as described before, the primary source $P_s$ is inputted into the adaptive filters 2*a* and 2*b* and also into the $C_{LMO}$ circuits 3*a* and 3*b* respectively. The primary source $P_s$ inputted to the adaptive filter 2*a* is outputted to the canceling signal processing circuit 4*a* as a canceling signal after being subjected to the sum of convolution products with a filter coefficient $W_{1(n)}$ and then generated as a canceling sound from the speaker 5*a* via the D/A converter 11*a*, the filtering circuit 12*a* and the AMP circuit 13*a* in this canceling signal processing circuit 4*a*. Once the canceling sound is generated, it is subjected to the influence of the speaker/microphone transmission characteristics $C_{11}$ and reaches a front receiving point where the canceling sound and the vibration noise are interfered with each other. The result of interference (attenuated sound) is detected as an error signal by the error microphone 7*a* after being subjected to the influence of the speaker/microphone characteristics $C_{11}$ and then the detected error signal is inputted to the LMS calculating circuit 6*a* via the error signal processing circuit 8. On the other hand, the canceling sound which reaches a rear noise receiving point is interfered with the vibration noise and the attenuated sound is detected by the error microphone 7*b* as an error signal after being subjected to the speaker/microphone characteristics $C_{21}$. The detected error signal is inputted to the LMS calculating circuit 6*a* via the error signal processing circuit 8.

Similarly primary source $P_s$ inputted to the adaptive filter 2*b* is outputted to the canceling signal processing circuit 4*b* as a canceling signal after being subjected to the sum of convolution products with a filter coefficient $W_{2(n)}$ and then generated as a canceling sound from the speaker 5*b*. This attenuated sound is detected as an error signal by the error microphone 7*a* after being subjected to the influence of the speaker/microphone characteristics $C_{12}$ and then the detected error signal is inputted to the LMS calculating circuit 6*b* via the error signal processing circuit 8. On the other hand, the canceling sound which reaches a rear noise receiving point is interfered with the vibration noise and the attenuated sound is detected by the error microphone 7*b* as an error signal after being subjected to the speaker/microphone characteristics $C_{22}$. The detected error signal is inputted to the LMS calculating circuit 6*b* via the error signal processing circuit 8.

On the other hand, the primary source $P_s$ inputted to the $C_{LMO}$ circuit 3*a* is subjected to the sum of convolution products with the compensation coefficients $C_{110}$ and $C_{210}$ established in the $C_{LMO}$ circuit 3*a* and outputted to the LMS calculating circuit 6*a*. Then in the LMS calculating circuit 6*a* the correction amount of the filter coefficient $W_{1(n)}$ for the adaptive filter 2*a* is obtained based upon the error signals from the error microphones 7*a* and 7*b* and upon the primary source synthesized in the $C_{LMO}$ circuit 3*a* according to the LMS algorithm and thus the filter coefficient $W_{1(n)}$ is updated therein.

Similarly, the primary source $P_s$ inputted to the $C_{LMO}$ circuit 3*b* is subjected to the sum of convolution products with the compensation coefficients $C_{120}$ and $C_{220}$ established in the $C_{CLM\ O}$ circuit 3*b*and outputted to the LMS calculating circuit 6*b*. Then the LMS calculating circuit 6*b* the correction amount of the filter coefficient $W_{2(n)}$ for the adaptive filter 2*b* is obtained based upon the error signals from the error microphones 7*a* and 7*b* and upon the primary source synthesized in the $C_{LMO}$ circuit 3*b* according to the LMS algorithm and thus the filter coefficient $W_{2(n)}$ is updated therein.

Next, in case where the vibration noise source has been shifted from the front :side to the rear side of the the change of driving conditions, in the Chd CLM Oselecting circuit 9*a*, the compensation coefficients $C_{110}$ and $C_{210}$ are selected from the maps based on the present engine operating condition, namely an engine loading $L_E$ and an engine rotational speed $N_E$ both of which are obtained from a fuel injection pulse $T_i$, so as to attenuate the vibration noise preferentially at the front noise receiving point of the passenger compartment and these coefficients are established in the $C_{LMO}$ circuit 3*a*.

Similarly, in the $C_{LMO}$ selecting circuit 9*b*, optimum compensation coefficients $C_{120}$ and $C_{220}$ are selected from the maps based on the above engine loading $L_E$ and engine $C_{LMO}$ circuit 3*b*. *rotational speed* $N_E$ and established in the $C_{LMO}$ circuit 3*b*. These compensation coefficients $C_{220}$ and $C_{120}$ are so established as not only to reduce the vibration noises preferentially at the noise receiving point of the rear passenger compartment but also to be higher in magnitudes than $C_{110}$ and $C_{210}$ respectively the source of vibration noises is located at the rear side of the vehicle at this moment. The primary source $P_s$ is inputted to the adaptive filters 2*a* and 2*b* and the $C_{LMO}$ circuits 3*b* and 3*b* and the noise reduction process goes on in the same manner as in case where the vibration source is located at the front side of the vehicle.

Although an example of the noise reduction control in a case where the vibration noise source is shifted from the front side to the rear side of the vehicle has been described in this preferred embodiment, it should be understood that the way of noise control will be exactly the same as in a case where a vibration noise source is shifted to any other portion of the vehicle.

In summary, the vehicle internal noise reduction present invention is characterized in system according to the present invention is characterized in attenuating the internal noises by generating an optimum canceling sound from speakers disposed in the passenger compartment by varying the canceling sound with good balance according to vehicle operating conditions, whereby a high control efficiency, an excellent response ability and a wide noise reduction coverage can be achieved.

Although the noise reduction system according to the present invention has been described about an example of using a MEFX-LMS algorithm comprising two error microphones and two speakers, it should be understood that other types of noise reduction systems using a MEFX-LMS algorithm comprising, for example, four error microphones and four speakers. Furthermore, in this preferred embodiment, a fuel injection pulse $T_i$ is employed for detecting engine operating conditions (engine loading information $L_E$ and engine rotational speed information $N_E$), however such alternative means may be applied as the engine loading information $L_E$ is obtained from an amount of induction air or a throttle opening degree or as the engine rotational speed information $N_E$ is obtained from a pulse signal derived from the crank angle sensor or from the cam angle sensor.

While the presently preferred embodiment of the present invention has been shown and described, it is to be understood that this disclosure is for the purpose of illustration and that various changes and modifications may be made without departing from the scope of the invention as set forth in the appended claims.

We claim:

1. A vehicle internal noise reduction system for attenuating a vibration noise sound within a passenger compartment by producing a canceling sound from a plurality of speakers, comprising:

operational conditions detecting means for detecting an engine operational condition signal;

canceling signal synthesizing means for synthesizing a vibration noise source signal with a filter coefficient of an adaptive filter into a canceling signal;

canceling sound generating means responsive to said canceling signal for generating a canceling sound from a speaker so as to cancel said vibration noise sounds within the passenger compartment;

error signal detecting means for detecting a state of noise reduction as an error signal;

compensation coefficients determining means for determining a series of compensation coefficients;

compensation coefficients memorizing means for memorizing said series of compensation coefficients;

compensation coefficients selecting means responsive to said engine operational condition signal for selecting a compensation coefficient from within said series of compensation coefficients memorized in said compensation coefficients memorizing means;

input signal compensation means for compensating said vibration noise source signal by said compensation coefficient; and filter coefficient updating means responsive to an output signal from said input signal compensating means and responsive to said error signal for updating said filter coefficient of said adaptive filter.

2. The vehicle internal noise reduction system according to claim 1, wherein said system comprises a plurality of independent channels, one channel having said canceling signal synthesizing means, said canceling sound generating means, error signal detecting means, compensation coefficients memorizing means, compensation coefficients selecting means, input signal compensating means and filter coefficients updating means, and comprises one common channel of operational conditions detecting means and compensation coefficients determiniing means.

3. The vehicle internal noise reduction system according to claim 1, wherein said vibration noise source signal is derived from an ignition pulse.

4. The vehicle internal noise reduction system according to claim 1, wherein said engine operational condition is expressed in a combination of an engine loading and an engine rotational speed.

5. The vehicle internal noise reduction system according to claim 1, wherein said vibration noise source signal is derived from a fuel injection pulse.

6. The vehicle internal noise reduction system according to claim 1, wherein said vibration noise source signal is derived from an ignition pulse.

7. The vehicle internal noise reduction system according to claim 1, wherein said vibration noise source signal is derived from a signal detected by a crank angle sensor.

8. The vehicle internal noise reduction system according to claim 1, wherein said series of compensation coefficients are a series of figures for correcting a filter coefficient so as to optimize a noise reduction state at all noise receiving points in any operational conditions.

9. The vehicle internal noise reduction system according to claim 1, wherein said series of compensation coefficients are memorized on a map for every channel with a parameter of said engine operational condition.

10. The vehicle internal noise reduction system according to claim 1, wherein said engine operational condition signal is a fuel injection pulse.

11. The vehicle internal noise reduction system according to claim 4, wherein said engine loading is obtained from a fuel injection pulse width and said engine rotational speed is obtained from a fuel injection pulse timing.

12. The vehicle internal noise reduction system according to claim 4, wherein said engine loading is obtained from a throttle opening degree.

13. The vehicle internal noise reduction system according to claim 4, wherein said engine loading is obtained from an amount of induction air.

14. The vehicle internal noise reduction system according to claim 4, wherein said engine rotational speed is obtained from a signal detected by a crank angle sensor.

15. The vehicle internal noise reduction system according to claim 1, wherein said engine rotational speed is obtained from a signal detected by a cam angle sensor.

* * * * *